US005988746A

United States Patent [19]

Raftery

[11] Patent Number: 5,988,746

[45] Date of Patent: Nov. 23, 1999

[54] SPLIT BACK CHAIR

[75] Inventor: William B. Raftery, Canton, Ohio

[73] Assignee: Raferty Design, Inc., Cartor, Ohio

[21] Appl. No.: 09/217,270

[22] Filed: Dec. 21, 1998

Related U.S. Application Data

[63] Continuation of application No. 08/778,552, Jan. 3, 1997, Pat. No. 5,887,946.

[51] Int. Cl.[6] ..... A47C 3/00

[52] U.S. Cl. ..... 297/297; 297/299; 297/452.31; 297/411.28; 297/354.11

[58] Field of Search ..... 297/299, 297, 297/286, 452.31, 452.15, 411.28, 411.44, 354.11, 44, 440.12, 42

[56] References Cited

U.S. PATENT DOCUMENTS

| | | | |
|---|---|---|---|
| 464,511 | 12/1891 | Milliken | 297/44 X |
| 2,395,468 | 2/1946 | Eames | 297/452.15 X |
| 4,834,453 | 5/1989 | Makiol | 297/354.11 X |
| 4,856,845 | 8/1989 | Massonnet | 297/452.15 X |
| 4,856,846 | 8/1989 | Lohmeyer | 297/452.15 X |
| 5,039,163 | 8/1991 | Tolleson | 297/299 X |
| 5,632,473 | 5/1997 | Dias Magalhaes Queiroz | 297/452.15 X |
| 5,662,381 | 9/1997 | Roossien et al. | 297/452.15 X |
| 5,711,572 | 1/1998 | Khan | 297/440.12 X |
| 5,752,143 | 5/1998 | Garelik | 297/440.12 |

FOREIGN PATENT DOCUMENTS

| | | | |
|---|---|---|---|
| 16167 | 7/1912 | Denmark | 297/44 |
| 196819 | 10/1986 | European Pat. Off. | 297/452.15 |
| 1118414 | 11/1961 | Germany | 297/452.15 |
| 9313841 | 3/1994 | Germany | A47C 3/12 |

*Primary Examiner*—Peter M. Cuomo
*Assistant Examiner*—David E. Allred
*Attorney, Agent, or Firm*—Sand & Sebolt

[57] ABSTRACT

A split back chair having a generally L-shaped seat member formed of a horizontal section and a vertical section, and separate independently movable right and left back portions. A first flat spring extends between and hingedly connects the back portions to one another and allows the back portions to pivot toward and away from another. A spring assembly connects each of the back portions to the seat member at right and left sides of the chair. Each spring assembly includes a cover plate and a second flat spring, both of which extend between the vertical section of the seat member and one of the back portions. A pair of removable arm rests are attached on the sides of the seat member. The cover plate houses the second flat spring and an end of the arm rests. The first flat spring and spring assemblies create a triflex action which allow the back portions to independently flex toward and away from one another creating a cradling effect from side to side, and allow the back portions to flex rearwardly to a reclined position.

12 Claims, 12 Drawing Sheets

SPLIT BACK CHAIR

CROSS REFERENCE TO RELATED APPLICATION

This application is a continuation application of U.S. application Ser. No. 08/778,552 filed Jan. 3, 1997 and issued as U.S. Pat. No. 5,887,946 Mar. 30, 1999, the disclosures of which are incorporated herein by reference.

BACKGROUND OF THE INVENTION

1. Technical Field

Generally, the invention relates to a chair. Particularly, the invention relates to a split back chair having a three-piece back which flexes to wrap around and cradle an occupant's back from side to side and which flexes toward and away from a seat member of the chair. Specifically the invention relates to a split back chair having a generally L-shaped seat member with a vertical section which forms a base of the back, and right and left back portions hingedly connected to the vertical section of the seat member and hingedly connected together.

2. Background Information

Many chairs have been designed which take ergonomic considerations into account. These chairs are designed to support the occupant's spine in an optimum fashion. A number of designs have already been proposed with this goal in mind. Some of these chairs involve a complex and correspondingly expensive mechanism. Others are not only so designed that adjusting them is a complicated process, with the result that the advantages they offer cannot fully be utilized, but are also fitted with superfluous parts making the chair too heavy to use. A chair designed in accordance with ergonomic principles must include means capable of adapting to the movements and the anatomy of the human body so that the occupant can work at optimum efficiency over long periods. Thus, difficulties of the kind outlined above have a negative rather than a positive effect. A correctly designed chair seat embraces and supports the body up to the pelvis in order to allow the trunk to move as freely as possible. When the occupant of the chair remains seated for a prolonged period of time, the natural position of the spine should be maintained.

Examples of chairs which support an occupant's back and spine are shown in U.S. Pat. No. 4,007,962 which discloses a chair with an adjustable back. The chair includes a central section hingedly attached to the rear of the seat, as well as an upper portion flexibly mounted to the top of the center section and extending around both sides thereof.

U.S. Pat. No. 4,157,203 discloses an articulated double back for chairs. The device provides an upper and lower section having a flexible hinge extending intermediate the upper and lower section to provide independent movement therebetween.

U.S. Pat. No. 4,585,272 discloses a chair having a back comprising a plurality of articulated segments. The chair has a reclineable backrest formed by a series of at least three superimposed segments articulated together about respective horizontal axes. The device is moveable to correspond to the arched back of the occupant.

U.S. Pat. No. 4,830,430 discloses a split back chair having a pair of springs formed of two U-bent spring rods which couple a lower back portion of the chair to an upper back portion of the chair. The effective spring length of the springs is adjustable or changeable by moving a slider connected to one of said back portions.

U.S. Pat. No. 5,195,804 discloses a backrest having two oval-shaped shells each concave to vertical and convex to horizontal. The backrest includes two backrest shells arranged at the sides and configured in a manner of contact surfaces of equestrian saddles.

U.S. Pat. No. 5,249,839 discloses a split back chair with independent control of a lumbar portion of a seat back and a thoracic portion of the seat back. The chair has a seat connected to a base and a control connected to the base under the seat. A first support is pivotally connected with the control and extends from the control to the thoracic portion of the seat back. A second support is pivotally connected with the control and extends from the control to the lumbar portion of the seat back. The two supports operate independently and the thoracic and lumbar portions of the seat back rotate independently rearward with respect to the seat.

U.S. Pat. No. 5,385,388 is a continuation-in-part of the '839 patent and is similar thereto having a second support extending to the lumbar portion of the seat back.

Although these prior art devices were adequate for the purpose for which they were intended, some of these chairs include backs which merely pivot toward and away from the seat member allowing the occupant to recline in the forward and backward direction. These chairs fail to disclose a split back having separate right and left portions hingedly interconnected to assure that movement of one of the right and left portions cause movement of the other of the right and left portions through a flexible interconnection. Other of these prior art chairs disclose a split back chair which requires highly mechanical components which facilitate a right and left flexing movement. These chairs are heavy and tend to be expensive to purchase due to the large number of parts associated with the chair.

Therefore, the need exists for a split back chair which has a simplified design and which includes a generally L-shaped seat member and separate right and left back portions hingedly interconnected and hingedly connected to the seat member.

SUMMARY OF THE INVENTION

Objectives of the present invention include providing a split back chair which has a simplified design.

Another objective is to provide such a chair which has separate and interconnected right and left back portions.

A further objective of the invention is to provide such a chair which has a triflex action which creates a cradling effect from side to side and a horizontal flex that creates a reclining action allowing for a more relaxed backward leaning position.

A still further objective of the invention is to provide such a chair which allows the resistance of the flexing movements to be easily adjusted to accommodate occupants of various sizes.

A further objective of the invention is to provide such a chair which has removable arm rests which attach to the seat member which attachment is integrated into a plastic cover plate to provide an attractive attachment.

These objectives and advantages are obtained by the split back chair of the present invention the general nature of which may be stated as including a base; a seat member attached to said base, said seat member having a pair of opposed sides; a first back portion hingedly connected to the seat member adjacent one of the sides of said seat member; and a second back portion hingedly connected to the seat member adjacent the other of the sides of the seat member and hingedly connected to the first back portion.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar Numerals Refer to Similar Parts Throughout the Drawings.

DESCRIPTION OF THE PREFERRED EMBODIMENTS

Figure 1:
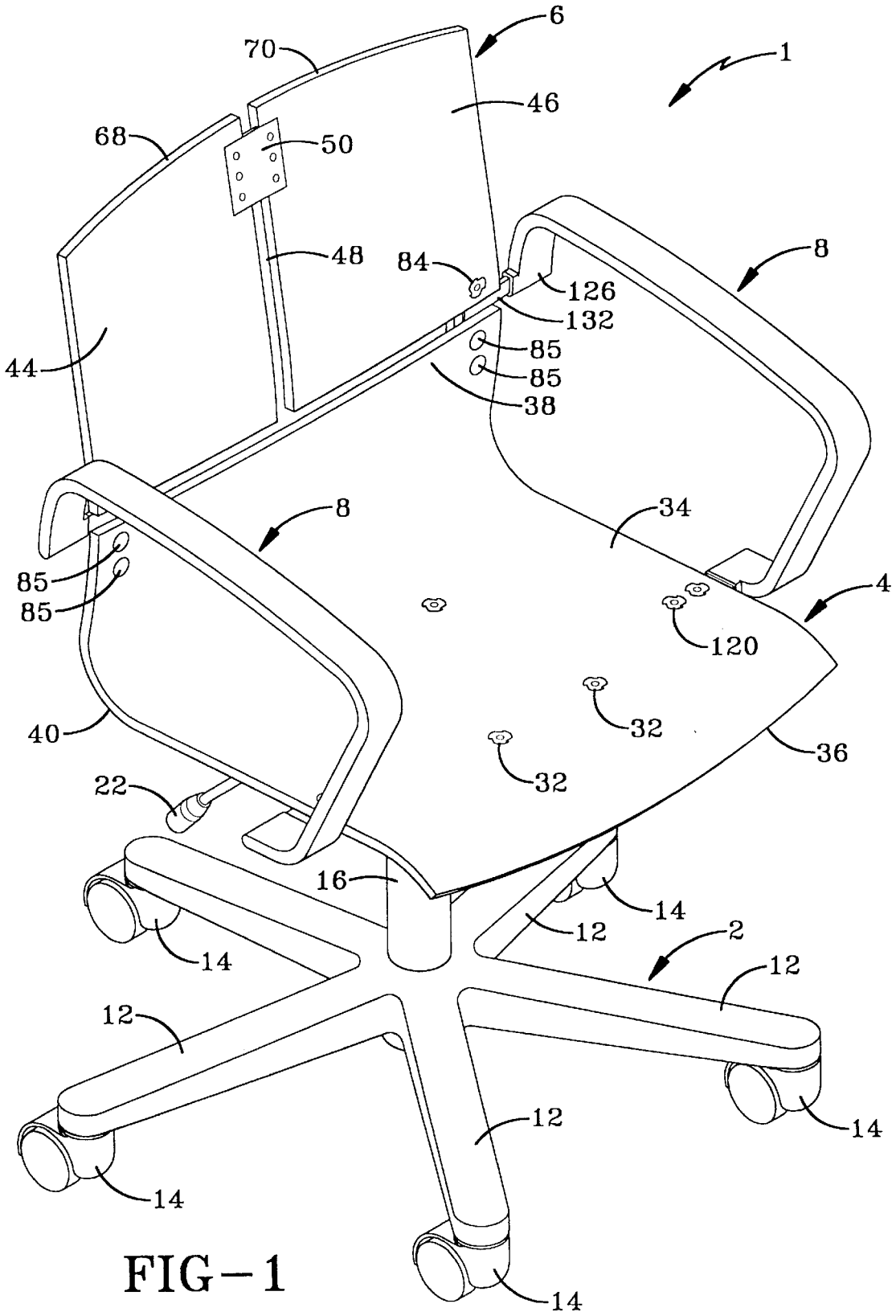
FIG. 1 is a perspective view of the split back chair of the present invention.
Figure 2:
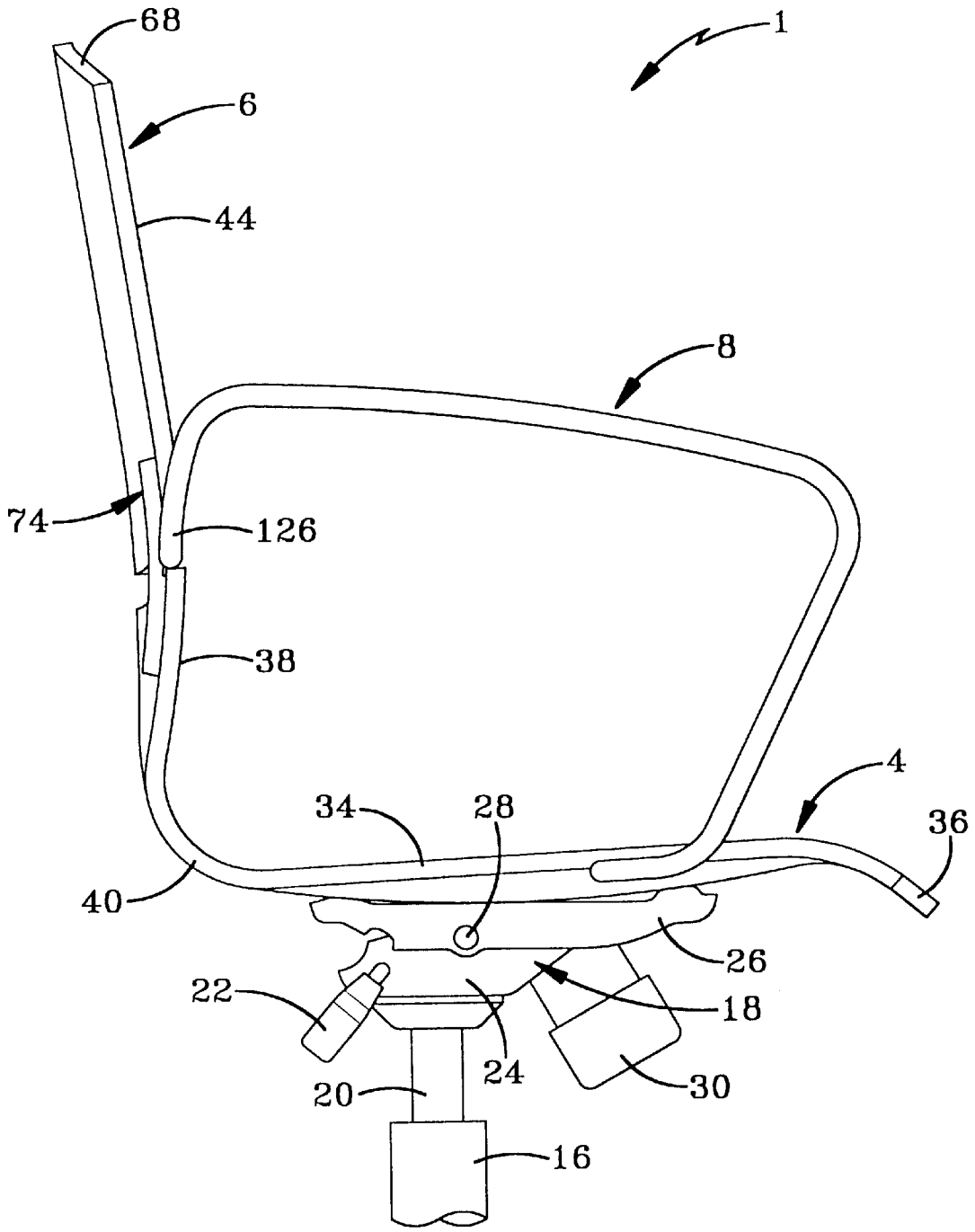
FIG. 2 is a fragmentary right side elevational view of the split back chair in FIG. 1.

The chair of the present invention is shown in FIG. 1 and is indicated generally at 1. Chair 1 includes a base 2, a seat member 4 attached to base 2, a back rest 6 extending generally vertically from seat member 4, and a pair of arm rests 8 disposed on each side of seat member 4. Base 2 includes five outwardly extending integrally formed legs 12, each having a rotatably mounted wheel 14 mounted on the bottom thereof. A generally cylindrical post 16 extends upwardly from a center of legs 12 and includes a usual seat adjustment mechanism 18 (FIG. 2). Adjustment mechanism 18 has a vertically adjustable telescopic section 20 and an adjustment handle 22 for controlling telescopic section 20. A bottom plate 24 is attached to the top of telescopic section 20 and a top plate 26 is pivotally mounted to bottom plate 24 by a pivot pin 28. An adjustment knob 30 (FIGS. 3 and 4) extends from the front of adjustment mechanism 18 to adjust the tension required to pivot top plate 26 and recline seat member 4 in the front-to-rear direction. Seat member 4 is attached to top plate 26 of base 2 by a plurality of bolts (not shown) and T-nuts 32 (FIG. 1).

Seat member 4 has a generally L-shaped configuration and includes a horizontally extending section 34 (FIGS. 1 and 2) having a slightly downwardly curved front lip 36, and a generally vertically extending section 38 connected to horizontal section 34 by a curved corner 40. Front lip 36 and corner 40 are curved to comfortably accommodate an occupant's legs and buttocks, respectively, to lessen fatigue of the occupant while sitting in chair 1 for extended periods of time. Vertical section 38 extends partially up the occupant's back and is bowed slightly inwardly (FIG. 2) toward the front of seat member 4 to provide lumbar support to the lower portion of the occupant's back.

Figure 3:
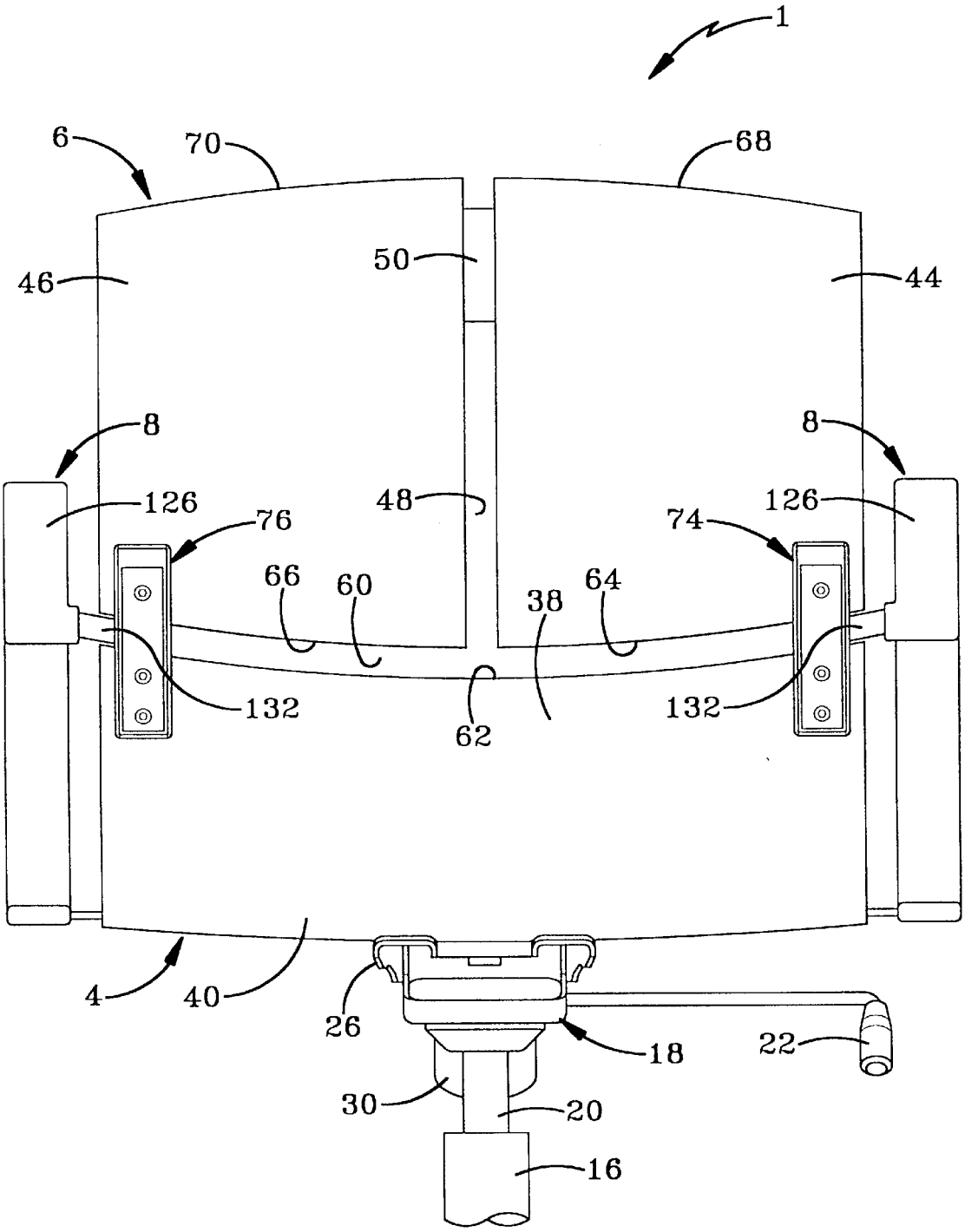
FIG. 3 is a fragmentary rear view of the chair of FIG. 2.
Figure 4:
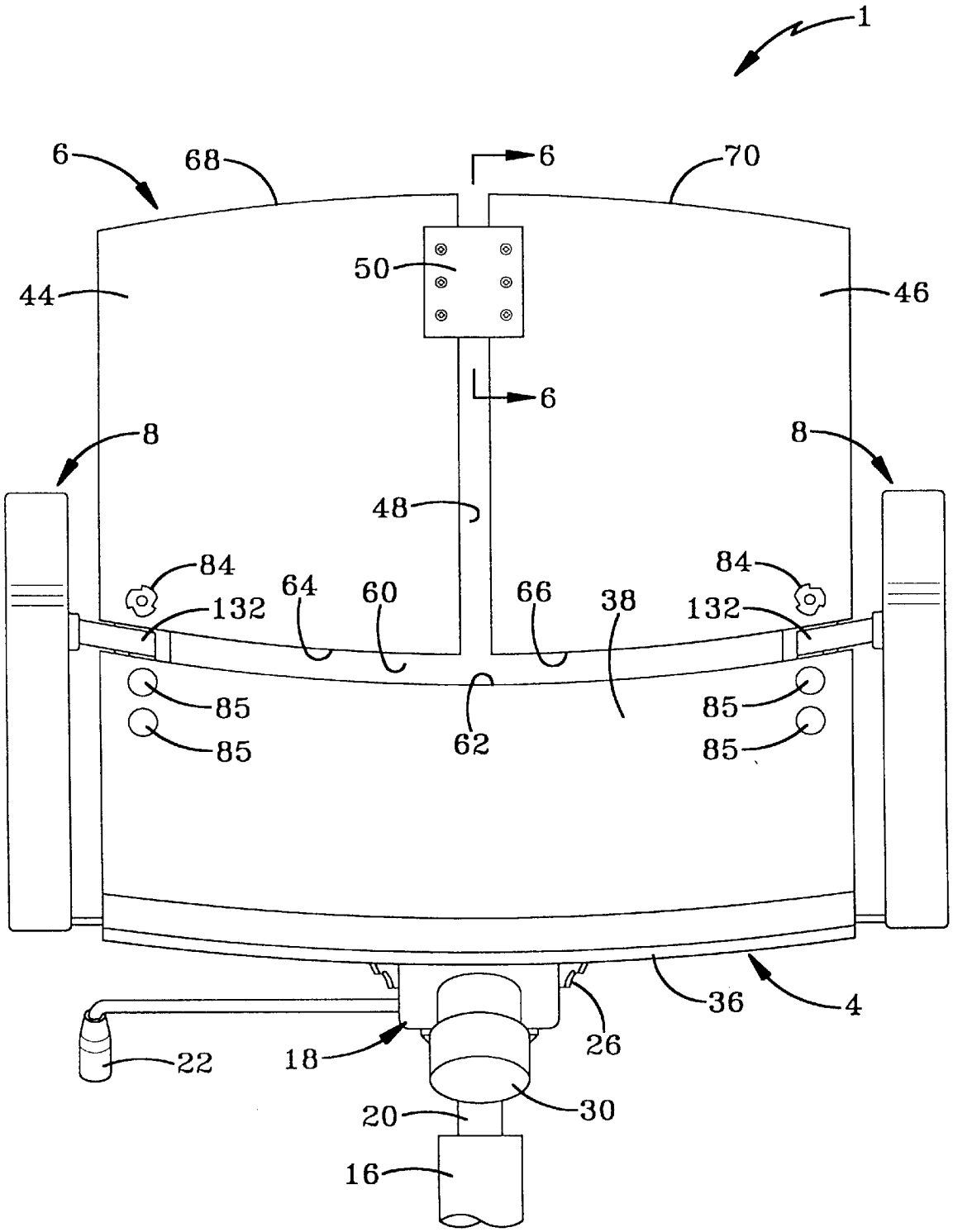
FIG. 4 is a fragmentary front view of the chair of FIG. 3.
Figure 5:
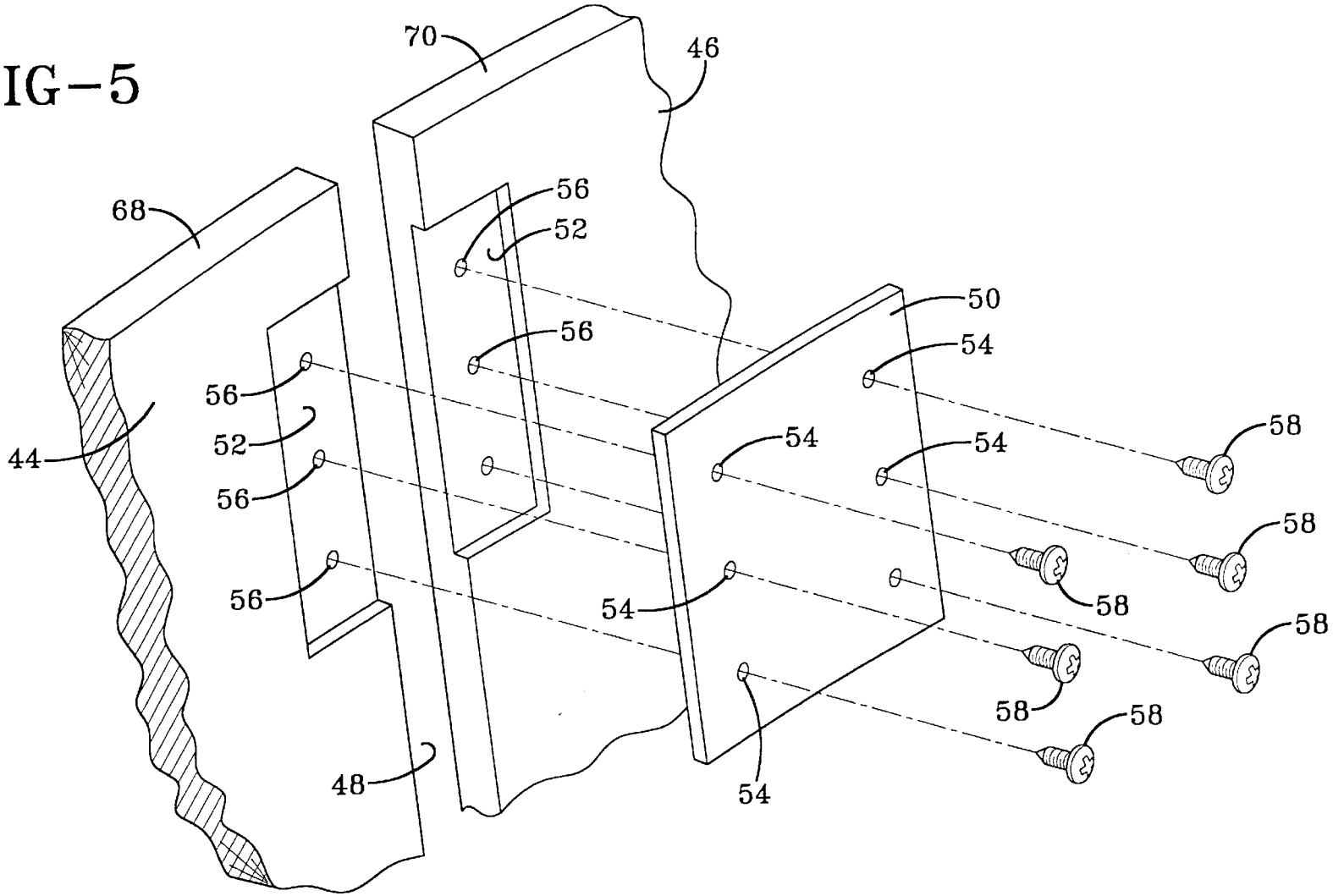
FIG. 5 is an exploded fragmentary perspective view showing a first spring which interconnects right and left back portions of the chair of FIG. 4.
Figure 6:
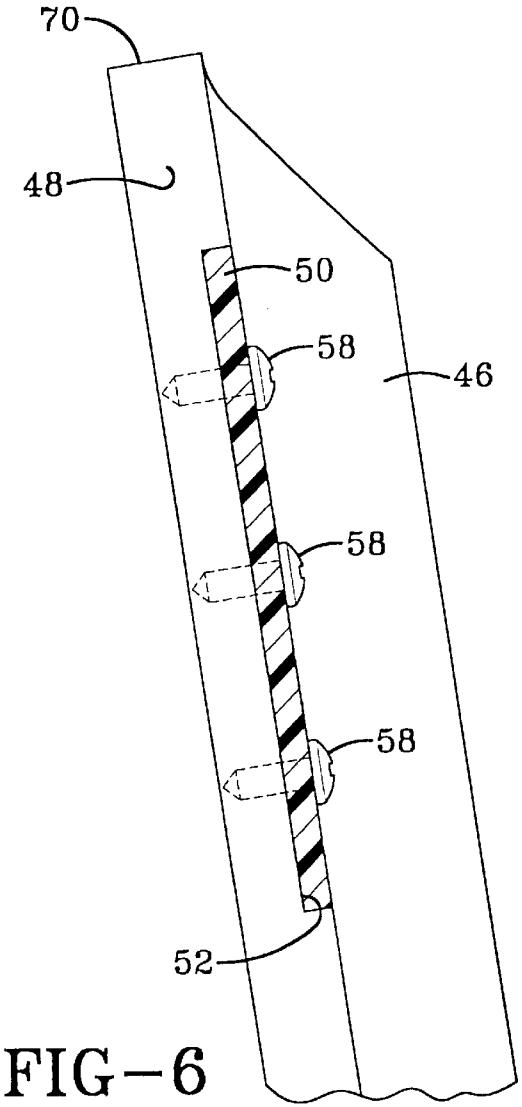
FIG. 6 is a fragmentary sectional view taken along line 6—6, FIG. 4.

In accordance with one of the features of the invention, back rest 6 includes separate independently movable right and left back portions 44 and 46, respectively (FIGS. 1, 3 and 4). Back portions 44 and 46 are separated by a vertically extending slot 48 formed therebetween, and are interconnected by a generally square-shaped flexible flat spring 50 (FIGS. 1, 4 and 5) which extends across slot 48. Spring 50 and slot 48 allow right and left back portions 44 and 46, respectively, to flex independently toward and away from one another as described below. A recessed area 52 (FIG. 5) is formed in right and left back portions 44 and 46, respectively, and is complimentary shaped to flat spring 50 to receive flat spring 50 therein. A plurality of holes 54 is formed in flat spring 50 along each side thereof which align with an equal number of holes 56 formed in recessed areas 52 of right and left back portions 44 and 46, respectively. A plurality of screws 58 (FIGS. 5 and 6) extend through holes 54 of flat spring 50 and are secured within holes 56 of right and left back portions 44 and 46, respectively, to secure flat spring 50 across slot 48 flexibly interconnecting right back portion 44 to left back portion 46.

In accordance with another of the features of the invention, a generally horizontally extending gap 60 (FIGS. 3 and 4) is formed between back portions 44 and 46 and vertical section 38 of seat member 4. Gap 60 has a slightly curved configuration formed by a concavely curved top edge 62 of vertical section 38 and convexly curved bottom edges 64 and 66 of right and left back portions 44 and 46, respectively. Right and left back portions 44 and 46, respectively, are bowed slightly outwardly from front to rear (FIG. 2), as is vertical section 38 of seat member 4, to conform to the general shape of the occupant's back. Similarly, horizontal section 34 of seat member 4 is bowed slightly downwardly to center and conform to the several shape of the occupant's buttock within seat member 4. Right and left back portions 44 and 46, respectively, have slightly convex top edges 68 and 70, respectively.

In accordance with another of the features of the invention, a pair of spring assemblies 74 and 76 (FIG. 3) independently attach right back portion 44 and left back portion 46, respectively, to vertical section 38. Spring assemblies 74 and 76 are mirror images of one another, and thus only spring assembly 76 will be described in detail. Spring assembly 76 is shown in FIGS. 9–12 and includes a relatively narrow flat spring 78 having a slightly vertically curved configuration, a plastic cover plate 80 and plurality of bolts 82 which are received by a T-nut 84 and a pair of cap nuts 85.

Flat spring 78 is preferably formed of a flexible plastic, such as polypropylene, but may be formed of other flexible materials which produce similar results without affecting the concept and spirit of the invention. The thickness of flat spring 78 may vary depending on the type of chair and the size of the occupant, as described below in further detail. A pair of lower counter sunk holes 88 are formed in a lower portion of flat spring 78 and an upper counter sunk hole 90 is formed in an upper portion of flat spring 78. Lower holes 88 vertically align with upper hole 90.

Cover plate 80 is generally rectangular-shaped and includes a pair of opposed side walls 108 and a pair of opposed end walls 110. A rectangular-shaped recessed area 92 is formed in cover plate 80 and has a first inner wall 94. Recessed area 92 has a length and width slightly larger than that of flat spring 78 and has a depth substantially equal to that of flat spring 78. A cavity 96 is formed within first inner wall 94 and has a second inner wall 98. Cavity 96 is inset slightly from side walls 108 and bottom end wall 110 of cover plate 80 forming a ridge 112 around the sides and bottom of wall 94. A rectangular opening 100 is formed in cover plate 80 adjacent a top edge of second wall 98.

A pair of lower holes 102 is formed in second wall 98 which axially align with lower holes 88 of flat spring 78. An upper hole 104 is formed in first wall 94 which axially aligns with upper hole 90 of flat spring 78. An elongated notch 106 is formed in the outer side wall 108 of cover plate 80. A pair of vertically aligned lower holes 116 are formed in vertical sections 38 of seat member 4 with the top hole being adjacent top edge 62 of vertical section 38. An upper hole 118 is formed in the lower left corner of left back portion 46 which vertically aligns with lower holes 116 of vertical section 38.

In accordance with another of the features of the invention, arm rests 8 are attached between horizontal section 34 and vertical section 38 of seat member 4. Each arm rest 8 is attached to horizontal section 34 by a pair of bolts not shown and T-nuts 120 (FIG. 1). Arm rests 8 extend upwardly from their attachment to horizontal section 34 a distance sufficient to allow an occupant of average size to comfortably rest his or her arms thereon when using chair 1 and extend rearwardly at a slightly curved inclination to again conform to the occupant. Arm rests 8 include a rear section 126 which extends downwardly and terminates adjacent gap 60 (FIG. 3).

Figure 9:
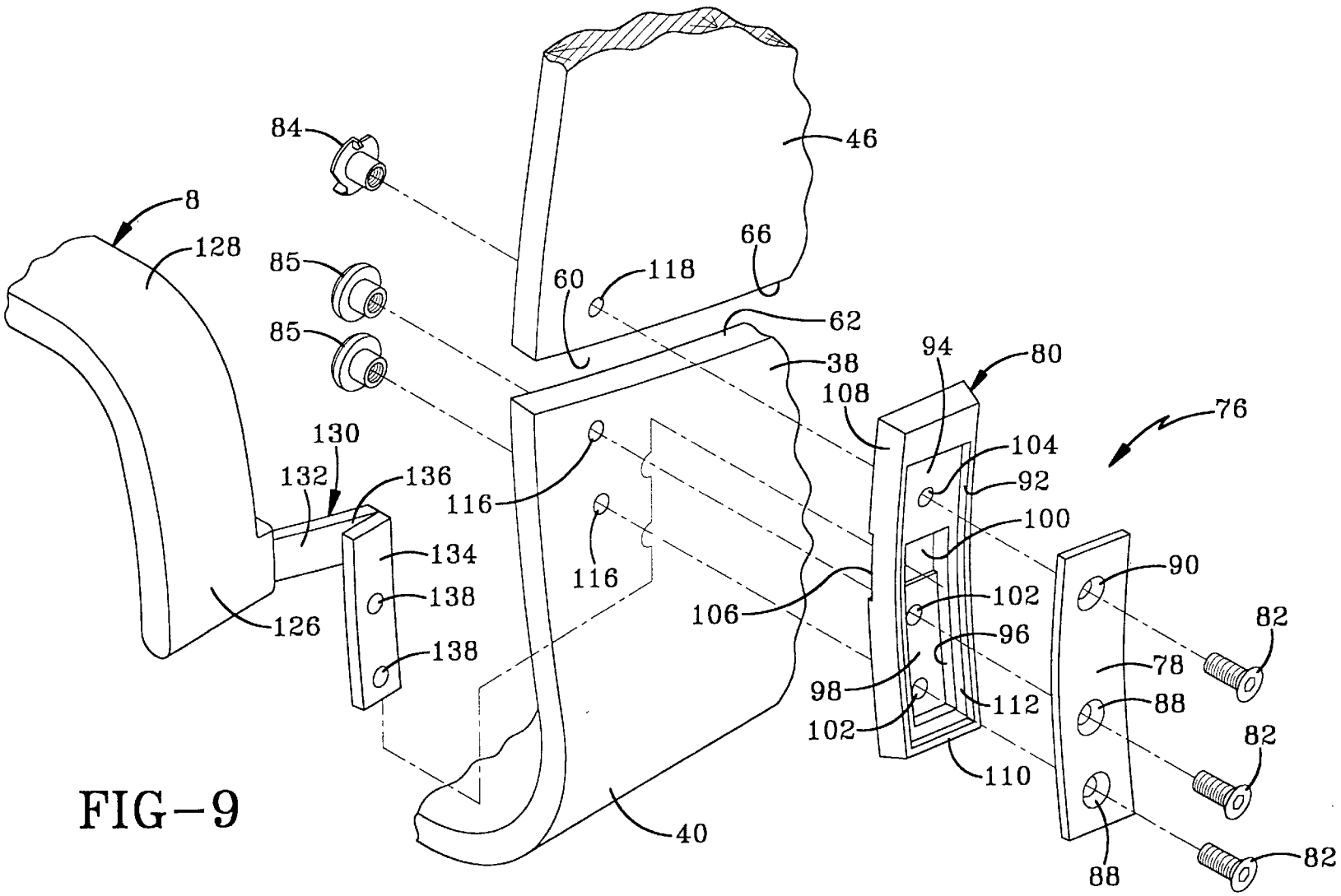
FIG. 9 is an exploded fragmentary perspective view of a second spring and showing the interconnection of an arm rest with the second spring.
Figure 10:
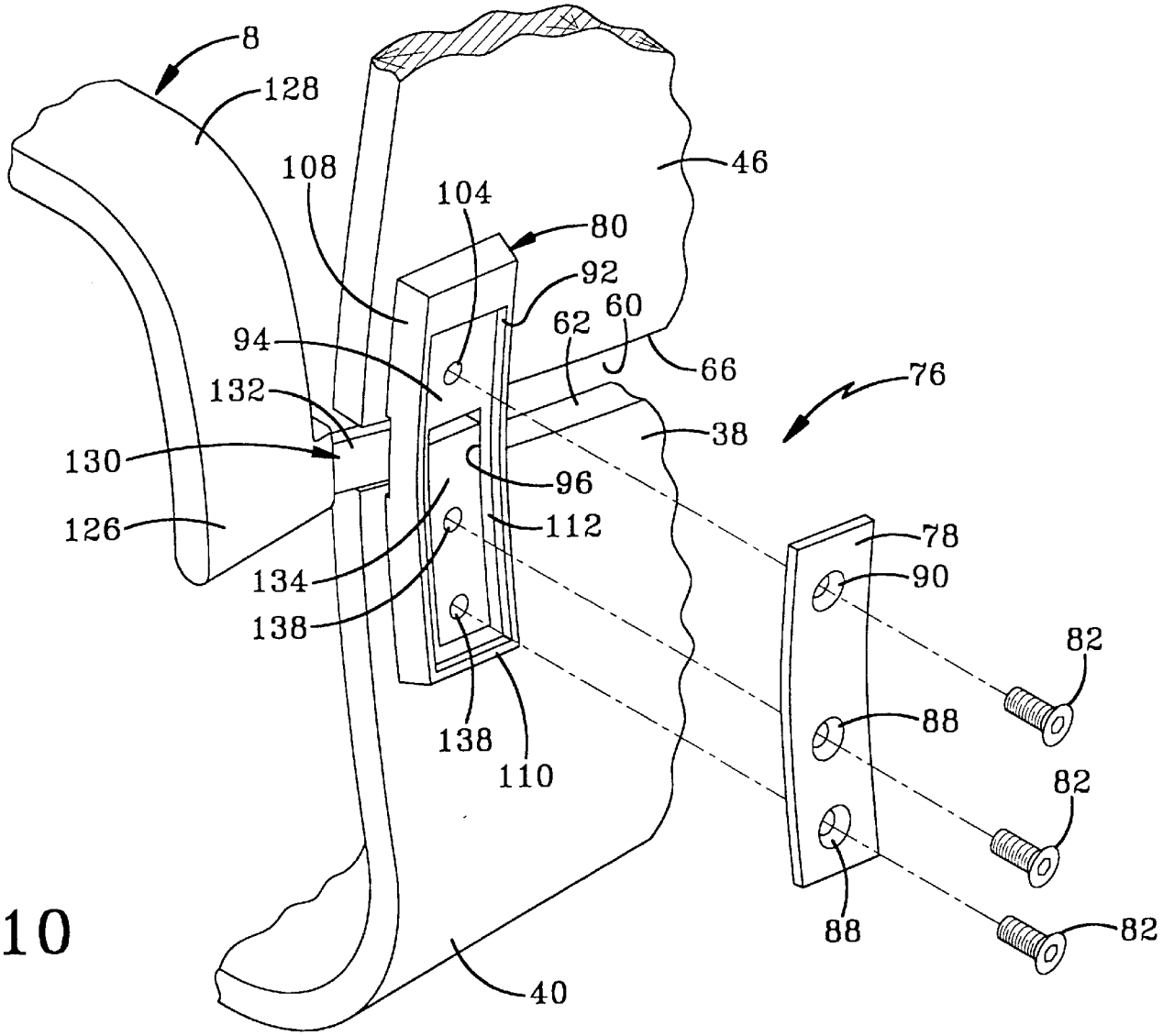
FIG. 10 is an exploded fragmentary perspective view similar to FIG. 9 showing arm the rest and second spring in a partially assembled position.

Arm rests 8 are preferably formed of metal and include an outer plastic cover 128 (FIG. 9). A generally L-shaped mounting bracket 130 extends inwardly from the end of rear section 126 of each arm rest 8 and includes a horizontal section 132 connected to a downwardly extending vertical section 134. Horizontal section 132 extends inwardly at a slight downward and rearward angle from rear section 126 and vertical section 134 extends outwardly from and at a slight angle to the rear outer edge of horizontal section 132. Horizontal and vertical sections 132 and 134, respectively, form a V-shaped gap 136 therebetween and have co-planar top edges. Horizontal section 132 has a height substantially equal to gap 60 formed between vertical section 38 of seat member 4 and right and left back portions 44 and 46, respectively.

A pair of vertically aligned holes 138 are formed in vertical section 134 of mounting bracket 130. Vertical section 134 extends within opening 100 of cover plate 80 whereby holes 138 align with lower holes 102 of cover plate 80. Vertical section 138 sits within cavity 96 (FIG. 10) adjacent to the outer surface of second wall 98. Horizontal section 132 of mounting bracket 130 extends within gap 60 and notch 106 allowing cover plate 80 to sit flush against the rear surface of back portion 46 and vertical section 38.

Holes 88, 138, 102 and 116 axially align with one another to receive bolts 82 therethrough. Similarly, holes 90, 104 and 118 axially align to receive another of bolts 82 therethrough. Lower bolts 82 are secured on a front surface of vertical section 38 by cap nuts 85 and upper bolt 82 is secured on the front surface of back portion 46 by T-nut 84.

Figure 12:
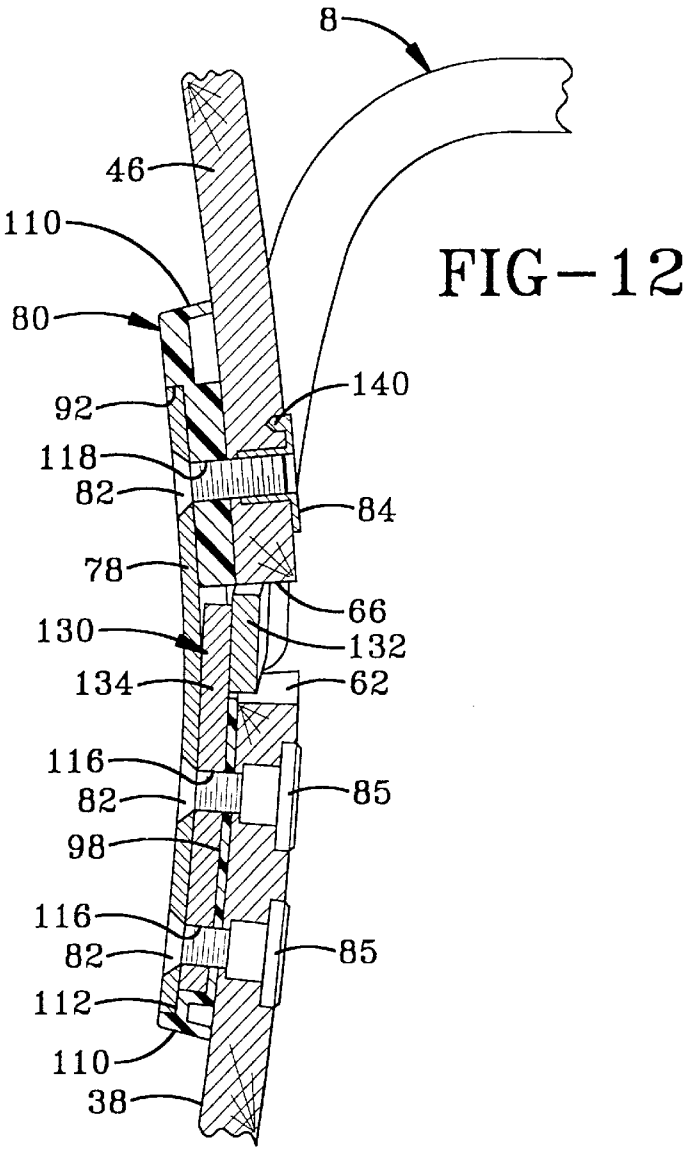
FIG. 12 is a fragmentary sectional view taken along line 12—12, FIG. 11.
Figure 11:
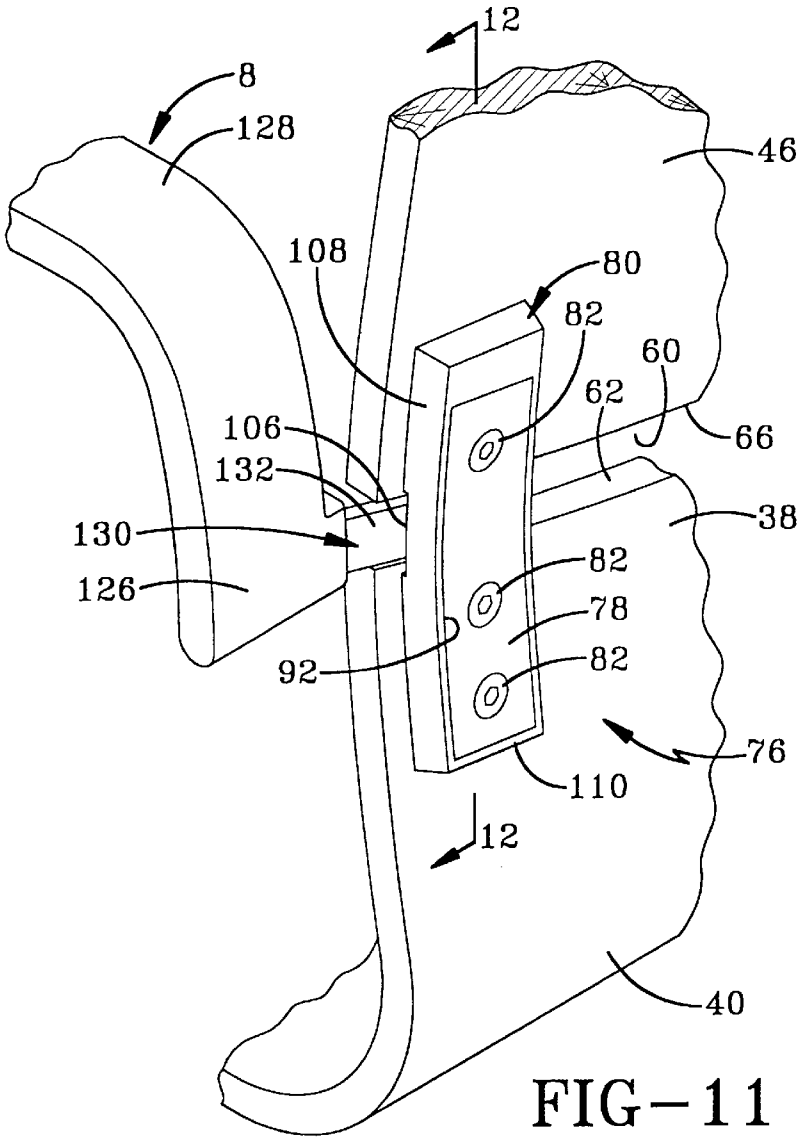
FIG. 11 is an exploded fragmentary perspective view similar to FIG. 10 showing the arm rest and second spring in a completely assembled position.

When spring assemblies 74 and 76 are assembled, flat spring 78 sits within recessed area 92 and is supported on first wall 94 and ridge 112 thereof to form a smooth and attractive hinged connection between right and left back portions 44 and 46, respectively, and vertical section 38. T-nuts 84 include inwardly extending teeth 140 (FIG. 9) which bite into back portions 44 and 46 to prevent T-nuts 84 from turning when top bolt 82 is being tightened thereto. Holes 116 of vertical section 38 are counter-bored as shown in FIG. 12 to receive cap nuts 85 and to form a smooth front surface of seat member 4.

An occupant sits on seat member 4 and uses adjustment handle 22 of seat adjustment mechanism 18 to adjust the vertical height of chair 1. The occupant uses adjustment knob 30 of seat adjustment mechanism 18 to adjust the tension of the pivotal movement of top plate 26 relative to bottom plate 24. The occupant rests his or her back against back rest 6 and the curved configuration of right and left back portions 44 and 46, respectively, and of vertical section 36 of seat member 4 wrap around and cradle the occupants back. As the occupant leans further backward, the occupant's upper back pushes against right and left back portions 44 and 46, respectively. Spring assemblies 74 and 76 flex or bend horizontally away from seat member 4 allowing back portions 44 and 46 to pivot or recline backwardly at an angle relative to vertical member 38. As back portions 44 and 46 are urged backwardly by the occupant's back flat spring 50 extending therebetween allows the back portions to pivot towards one another facilitating a wrapping effect of backrest 6. This triflex action of spring assemblies 74 and 76 flexing in conjunction with flat spring 50 creates a cradling effect from side to side an addition to the horizontal flex of back rest 6 away from seat member 4, providing a comfortable and relaxed configuration when the occupant is leaning back.

The curved configuration of gap 60 allows spring assembly 74 and 76 to be located partially up back rest 6 and provides clearance which allows back portion 44 and 46 to pivot rearwardly. Further, the curved configuration of gap 60 prevents top edge 62 of vertical section 38 from hitting and cutting into the occupant's back in an uncomfortable manner.

Figure 14:
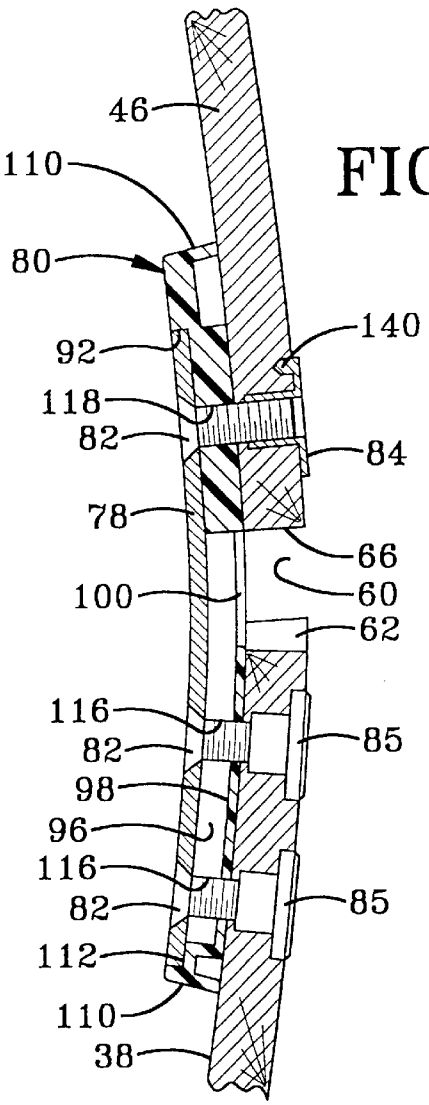
FIG. 14 is a fragmentary sectional view taken along line 14—14, FIG. 13.
Figure 13:
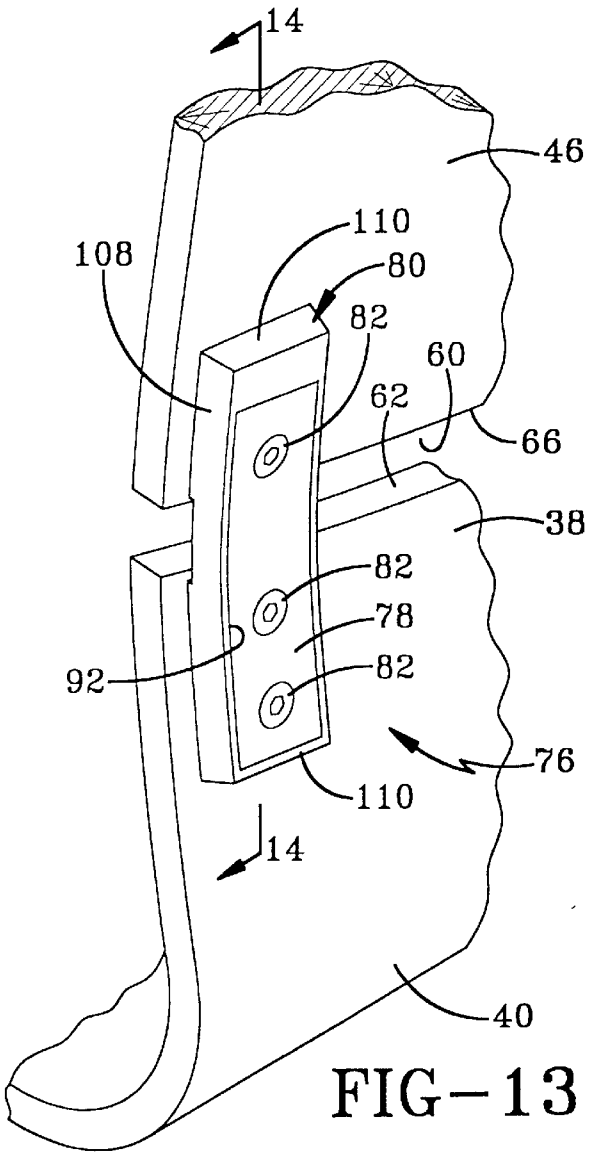
FIG. 13 is a fragmentary perspective view similar to FIG. 11 showing the second spring in a completely assembled position free of the arm rest.
Figure 15:
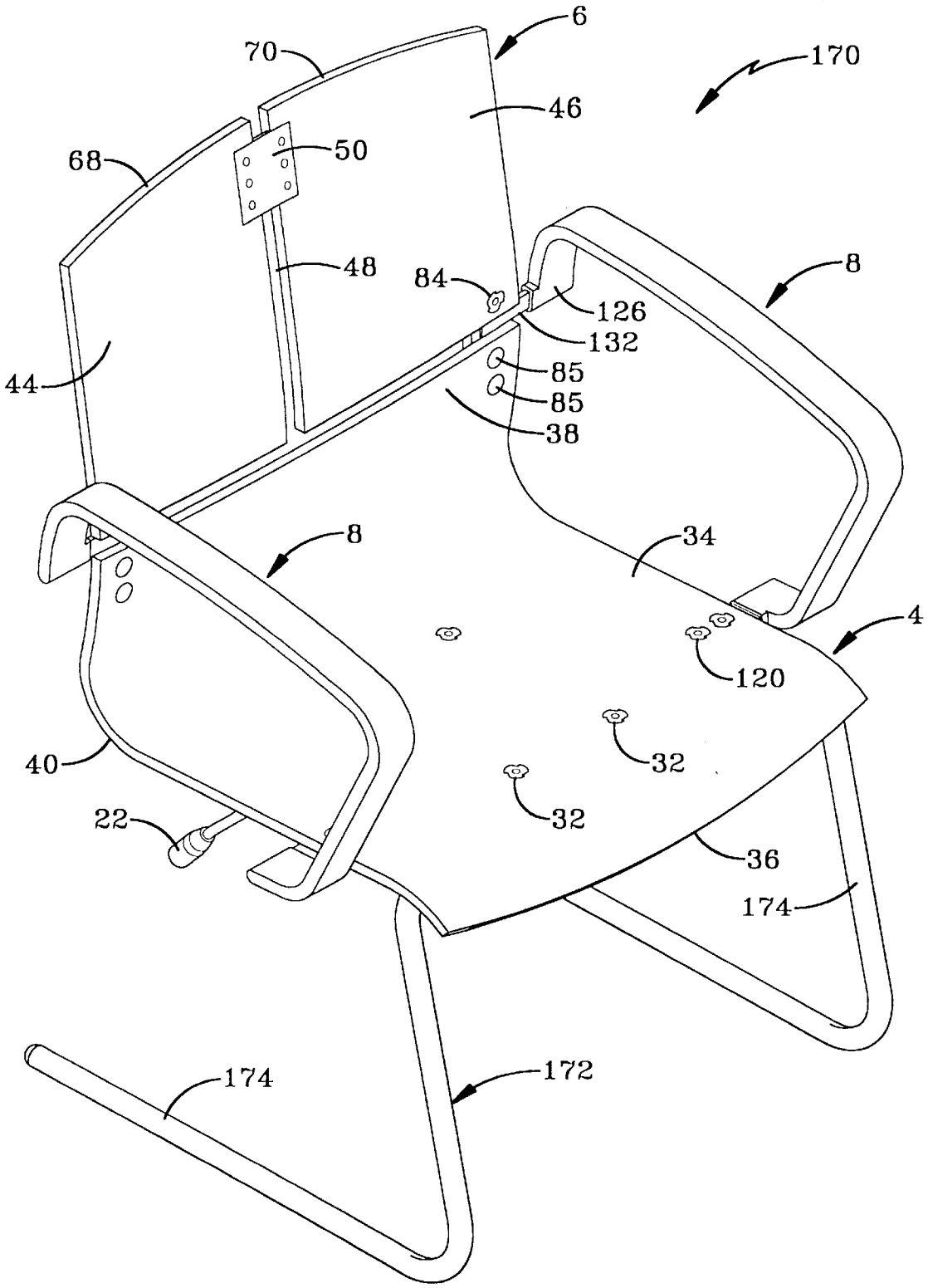
FIG. 15 is a perspective view of a second embodiment of the split back chair of the present invention shown having an alternative base.

The unique arrangement of spring assemblies 74 and 76 allow arm rests 8 to be removed from chair 1 by removing lower bolts 82 from cap nuts 85. Vertical section 134 of mounting bracket 130 slides through opening 100 (FIG. 14) of cover plate 80 allowing arm rests 8 to be removed from chair 1 without having to remove the entire spring assembly from its engagement between the back portions and vertical section 38. The attachment of arm rest 8 to vertical section 38 prevents arm rests 8 from affecting the pivotal movement of back portions 44 and 46 relative to vertical section 38. As shown in FIG. 14, ridge 112 of cover plate 80 supports flat spring 78 with or without vertical section 134 of mounting bracket 130 positioned within cavity 98. Cover plate 80 is a one-piece member molded of a flexible plastic which allows cover plate 80 to flex with flat spring 78 toward and away from seat member 4.

Figure 8:
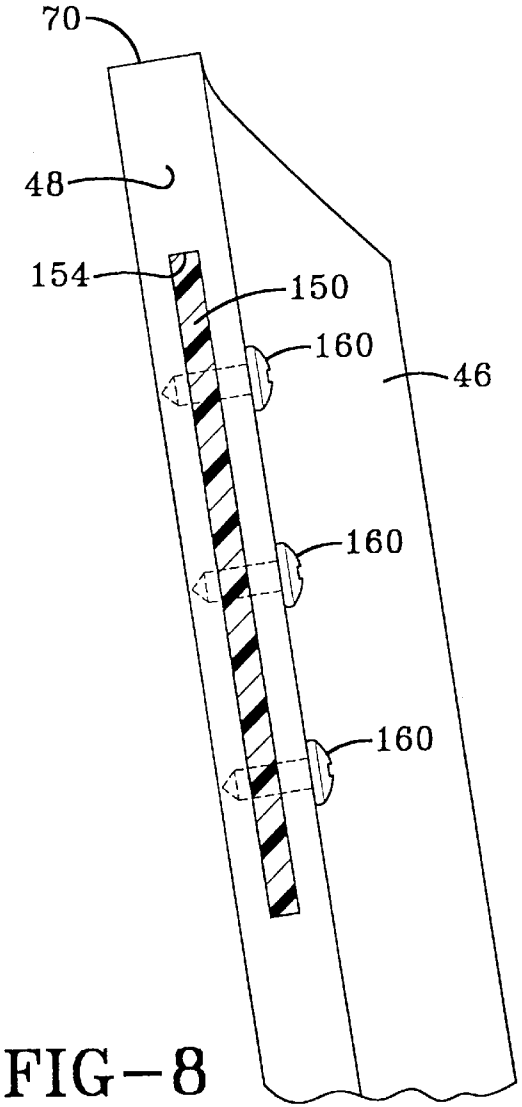
FIG. 8 is a fragmentary sectional view of the spring of FIG. 7.
Figure 7:
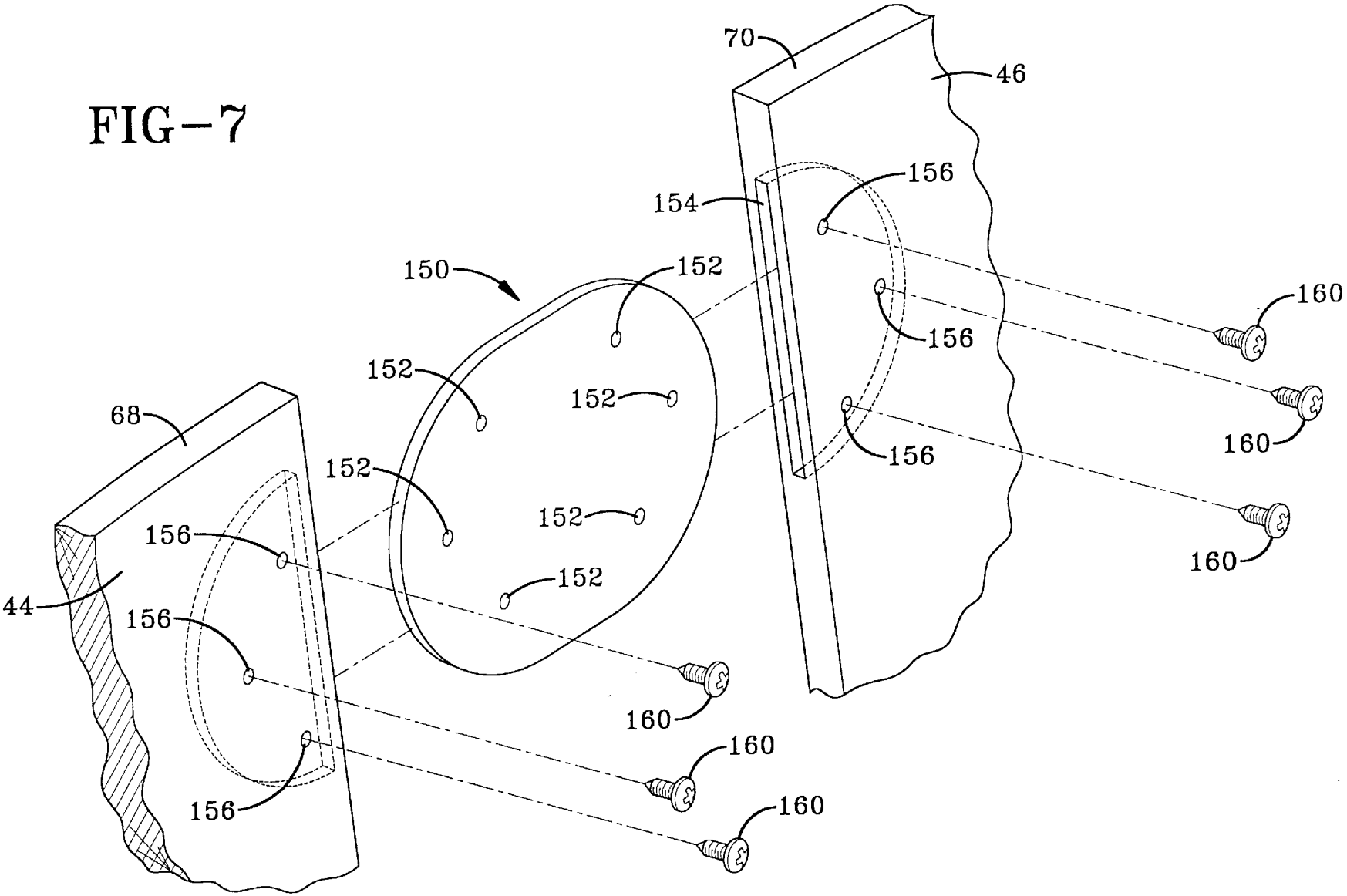
FIG. 7 s an exploded fragmentary perspective view of a second embodiment of the first spring showing an alternative attachment of the first spring to the right and left back portions.

An alternative embodiment of flat spring 50 is shown in FIGS. 7 and 8 and is indicated generally at 150. Flat spring 150 is generally oval-shaped and has a plurality of circular holes 152 formed therein. A slotted opening 154 is formed in the vertical inner edge of each back portion 44 and 46. Slotted openings 154 are complimentary-shaped to the ends of flat spring 150 (FIG. 7) to receive a portion of flat spring 150 therein. A plurality of holes 156 is formed in each back portion 44 and 46 which align with holes 152 of flat spring 150 when flat spring 150 is positioned therein. A plurality of screws 160 extend within holes 156 and 152 (FIG. 8) to secure flat spring 150 between back portions 44 and 46. Slots 154 receive less than ½ of flat spring 50 leaving a middle portion of flat spring 150 extending between back portions 44 and 46 within vertical extending slots 48. Flat spring 150 provides a hidden attractive hinged assembly of back portions 44 and 46.

A second embodiment of the chair of the present invention is shown in FIG. 14 and is indicated generally at 170. Chair 170 is substantially similar to chair 1 and includes an alternative base 172 which is of a usual stationary type free of wheels and a swivelable mounting assembly. Base 172 is generally tubular in shape and includes generally L-shaped legs 174 which allows chair 170 to recline or rock slightly rearwardly when chair 170 is used by an occupant.

It is understood that chairs 1 and 170 may be formed with a higher back rest which extends further upward to support a larger portion of the occupant's back. The flat spring extending between the back portions of the high back chair may be positioned slightly higher on back rest 6 than flat springs 50 and 150 of chair 1. Flat springs 78 of the high back chair require a greater thickness than flat springs 78 of chairs 1 and 170 to support the additional weight of the larger back portions. Further, flat springs 78 of chairs 1 and 170 may be formed of a variety of thicknesses to accommodate occupant's of various weights and sizes. Bolts 82 may be easily removed with an Allen wrench to replace springs 78 assuring that back rest 6 has a hinged resistance which accommodates the weight and size of the occupant. Also, it is understood that chairs 1 and 170, and alternatively the high back, chair may include a seat cushion covering horizontal section 34 of seat member 4 and a pair of back rest cushions covering right and left back portions 44 and 46.

Accordingly, spring assemblies 74 and 76 and flat spring 50 allow right and left back portions 44 and 46 to move independently of one another creating a triflex action which cradles the occupant's back from side to side and allows back rest 6 to flex horizontally toward and away from seat member 4. Further, the attachment of arms rests 8 to vertical section 38 and their integration with spring assemblies 74 and 76 allow arm rests 8 to be easily attached or removed from chair 1 without completely disassembling spring assemblies 74 or 76. Cover plate 80 and flat springs 78 allow right and left back portions 44 and 46 of back rest 6 to pivot angularly backwards in a relaxed reclined position. Also, back portions 44 and 46 are connected by flat spring 50 or flat spring 150 which facilitate the side to side cradling effect of back rest 6. Flat springs 78 may be molded of a variety of spring thicknesses to accommodated high back chairs as well as low back chairs and to accommodate occupants of various sizes. The curved configuration of gap 60 provides a comfortable edge to top 62 of vertical section 38 and prevents vertical section 38 from cutting into the occupant's back in an uncomfortable manner.

Accordingly, the improved split back chair is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved split back chair is constructed and used, the characteristics of the construction, and the advantageous, new and useful results obtained; the new and useful structures, devices, elements, arrangements, parts and combinations, are set forth in the appended claims.

What is claimed is:

1. A chair including:

a base;

a seat member mounted on said base, said seat member having a pair of opposed sides;

a first back portion connected to the seat member adjacent one of the sides of said seat member;

a second back portion connected to the seat member adjacent the other of the sides of the seat member and connected to the first back portion;

the first and second back portions being separated from the seat member and forming a generally horizontally extending gap between the seat member and the back portions;

the gap being arcuately shaped the first back portion being spaced from the second back portion forming a vertically extending slot; and a first resilient member extending across the vertically extending slot to hingedly connect the first back portion to the second back portion.

2. A chair including:

a base;

a seat member mounted on said base, said seat member having a pair of opposed sides;

the seat member being generally L-shaped and including a horizontal section and a vertical section extending generally upwardly from the horizontal section;

a first back portion connected to the seat member adjacent one of the sides of said seat member;

a second back portion connected to the seat member adjacent the other of the sides of the seat member and connected to the first back portion;

the first and second back portions extending generally co-planar to the vertical section of the seat member;

the first and second back portions being separated from the seat member and forming a generally horizontally extending gap between the seat member and the back portions;

the gap being arcuately shaped; and the vertical section of the seat member having a top edge, the top edge being concavely curved; each of the back portions having a lower edge, each lower edge being convexly curved.

3. The chair defined in claim 2, further comprising a pair of second resilient members, each second resilient member extending between a back portion and the vertical section of the seat member.

4. A chair including:

a base;

a seat member mounted on said base, said seat member having a pair of opposed sides;

a first resilient member and a pair of second resilient members;

a first back portion hingedly connected to the seat member adjacent one of the sides of said seat member with one of the second resilient members; and a second back portion hingedly connected to the seat member adjacent the other of the sides of the seat member with the other of the second resilient members;

the first back portion being hingedly connected to the second back portion with the first resilient member; and an arm rest extending along each side of the seat member, each arm rest having a first end connected to the seat member and a rear end connected to one of the second resilient members.

5. The chair defined in claim 4, wherein each rear end of each arm rest is also connected to the seat member.

6. The chair defined in claim 5, wherein the first and second back portions are separated by a vertically extending slot.

7. The chair defined in claim 6, wherein the back portions are separated from the seat member by a gap.

8. The chair defined in claim 7, wherein each of the resilient members is a flat spring.

9. A chair including:

a base;

a seat member mounted on said base, said seat member having a pair of opposed sides;

said seat member having a horizontal section with a front portion and rear portion and a vertical section extending up from the rear portion;

a first resilient member and a pair of second resilient members;

a first back portion connected to the seat member adjacent one of the sides of said seat member with one of the second resilient members to define a horizontal gap between the first back portion and the seat member;

a second back portion connected to the seat member adjacent the other of the sides of the seat member with the other of the second resilient members to define a horizontal gap between the second back portion and the seat member;

the first back portion being connecting to the second back portion by the first resilient member;

the first and second back portions being separated by a vertical slot; and the first resilient member allowing the back portions to pivot along the vertical slot.

10. The chair defined in claim 9, wherein the first resilient member is connected to each back portion by at least two spaced connectors.

11. The chair defined in claim 10, wherein the first resilient member is connected to each back portion by three spaced connectors.

12. The chair defined in claim 11, wherein the three spaced connectors are vertically aligned.

* * * * *

UNITED STATES PATENT AND TRADEMARK OFFICE

CERTIFICATE OF CORRECTION

PATENT NO. : 5,988,746
DATED : November 23, 1999
INVENTOR(S) : William B. Raftery It is certified that error appears in the above-identified patent and that said Letters Patent is hereby corrected as shown below:

Title page,
Item [73], should read -- Assignee: Raftery Design, Inc., Canton, Ohio --

Signed and Sealed this

Twenty-fifth Day of February, 2003

JAMES E. ROGAN
*Director of the United States Patent and Trademark Office*